US012383082B1

(12) United States Patent
Bailey

(10) Patent No.: US 12,383,082 B1
(45) Date of Patent: Aug. 12, 2025

(54) MODULAR CUSTOMIZABLE RETAIL SHELVING APPARATUS

(71) Applicant: Kyndra Lee Bailey, Maxwell, TX (US)

(72) Inventor: Kyndra Lee Bailey, Maxwell, TX (US)

(73) Assignee: KynYouBelievelt LLC, Lockhart, TX (US)

( * ) Notice: Subject to any disclaimer, the term of this patent is extended or adjusted under 35 U.S.C. 154(b) by 0 days.

(21) Appl. No.: 18/765,455

(22) Filed: Jul. 8, 2024

(51) Int. Cl.
*A47F 5/08* (2006.01)
*A47F 5/00* (2006.01)

(52) U.S. Cl.
CPC ..... *A47F 5/0815* (2013.01); *A47F 5/0043* (2013.01); *A47F 5/0823* (2013.01)

(58) Field of Classification Search
CPC .... A47F 5/0815; A47F 5/0043; A47F 5/0823; A47F 5/0884; A47B 96/02; A47B 96/027
USPC ..... 211/186, 57.1, 75, 88.01, 88.02, 90.01, 211/184, 72; 248/220.31, 220.41, 220.42, 248/220.43
See application file for complete search history.

(56) References Cited

U.S. PATENT DOCUMENTS 2,642,330 A * 6/1953 Armour ..... A47B 47/042 297/440.13
3,489,290 A 1/1970 Larson
4,185,911 A 1/1980 Guillemette
4,552,272 A * 11/1985 Field ..... A47F 5/0846 248/222.51
4,560,072 A * 12/1985 Burrell ..... A47F 5/00 211/75
4,562,776 A * 1/1986 Miranda ..... A47B 47/042 108/190
4,723,663 A 2/1988 Learn
4,832,421 A * 5/1989 Shoffner ..... A47B 47/042 312/265.5
4,874,210 A * 10/1989 Carroll ..... A47F 5/0025 312/121
4,898,354 A 2/1990 Whittington et al.
5,012,937 A * 5/1991 Owens ..... A47F 5/04 40/124
5,101,988 A * 4/1992 Meyer ..... A47F 5/08 211/184
5,141,115 A * 8/1992 Nicoll ..... A47F 7/147 211/88.01
5,255,802 A 10/1993 Krinke et al.
5,379,976 A * 1/1995 DeGirolamo ..... B25H 3/04 248/222.51
5,464,103 A * 11/1995 O'Brien ..... A47B 57/20 211/88.01

(Continued)

*Primary Examiner* — Jennifer E. Novosad
(74) *Attorney, Agent, or Firm* — Dunlap Bennett & Ludwig, PLLC; Jeff A. Burke

(57) ABSTRACT

The modular shelving apparatus can have at least two mounting brackets each with a plurality of posts protruding from a face and a first and second slot disposed substantially perpendicular to each other thereon. A removable ledge portion can be mounted to each of the first slots of each of the mounting brackets and can include a plurality of slots for inserting dividers therein. A tray portion can be mounted to each of the second slots of each of the mounting brackets and can include a plurality of posts protruding from a face thereof. Removable dividers can be installed in one or more of the plurality of slots of the removable ledge to configure the modular shelving apparatus based on needs.

3 Claims, 4 Drawing Sheets

(56) References Cited

U.S. PATENT DOCUMENTS

| | | | | |
|---|---|---|---|---|
| 5,974,707 | A * | 11/1999 | Kowalczyk | G09F 1/14 40/124.4 |
| 6,591,995 | B1 * | 7/2003 | Grove | A47F 5/0815 211/87.01 |
| 6,793,070 | B2 | 9/2004 | Dye | |
| 6,845,871 | B1 * | 1/2005 | Culp | A47B 47/042 211/186 |
| 7,424,958 | B1 * | 9/2008 | Eley | A47F 5/0815 211/70.6 |
| 7,743,933 | B2 | 6/2010 | Martin et al. | |
| 8,162,158 | B2 | 4/2012 | Northrup, Jr. et al. | |
| 8,662,326 | B2 * | 3/2014 | Brick | A47B 47/042 211/186 |
| 8,789,899 | B2 | 7/2014 | Pirro et al. | |
| 9,144,331 | B2 * | 9/2015 | Gold | A47F 5/0823 |
| 9,215,939 | B2 | 12/2015 | Zobel et al. | |
| 9,468,313 | B2 | 10/2016 | Kniffen | |
| 10,213,016 | B2 | 2/2019 | Bellar et al. | |
| 10,687,617 | B2 * | 6/2020 | Davis | A47B 96/061 |
| 10,716,399 | B2 * | 7/2020 | Brown | A47B 88/90 |
| 10,932,593 | B2 * | 3/2021 | Altizer | A47F 5/0815 |
| 10,952,534 | B2 | 3/2021 | Peck et al. | |
| 11,064,818 | B2 | 7/2021 | Vogler et al. | |
| 11,241,106 | B2 * | 2/2022 | Rodriguez | A47B 96/068 |
| 11,576,486 | B2 * | 2/2023 | Parker | A47F 5/0823 |
| 11,687,865 | B2 | 6/2023 | Bronicki | |
| 11,833,444 | B2 * | 12/2023 | Landau | A63H 33/088 |
| D1,040,586 | S * | 9/2024 | Gomez Abuin | D6/705.7 |
| 2006/0207955 | A1 * | 9/2006 | Ouyang | A47F 5/0043 211/192 |
| 2007/0184723 | A1 | 8/2007 | Murphy | |
| 2012/0241401 | A1 | 9/2012 | Galey | |
| 2012/0312764 | A1 * | 12/2012 | Walter | A47F 5/083 211/105.1 |

* cited by examiner

MODULAR CUSTOMIZABLE RETAIL SHELVING APPARATUS

BACKGROUND OF THE INVENTION

The present invention relates to retail shelving, and, more particularly, to modular retail shelving configured to be customizable based on differing applications.

Shelving has traditionally been utilized for storage and organization of a variety of products in both retail and non-retail settings. Many shelving systems utilized are modular, allowing for reconfiguration of the shelving system to suit a specific product or need. However, disadvantages associated with modular retail shelving are numerous and include such things as bulky manufacturer specific backing, fixed width shelving, and a requirement to disassemble the shelving prior to reconfiguration.

U.S. Pat. No. 9,468,313 illustrates a prior art modular shelving system with a plurality of dividers configured to be customizably affixed to the tray. However, the system of the '313 patent is disadvantageous because the tray is a fixed size thereby limiting customization and requiring manufacture and complete replacement of an entirely new tray if a different size is required. Furthermore, the system of '313 requires additional fastening mechanism to mount the tray.

U.S. Pat. No. 8,162,158 illustrates a second prior art modular shelving system with mounting brackets, a plurality of dividers, and a tray portion configured to be customizably affixed to a slatwall. However, the system of the '158 patent is disadvantageous because in order to reconfigure the dividers the system must be disassembled thereby creating inefficiencies in retail display.

U.S. Pat. No. 5,255,802 illustrates a third prior art modular shelving system with a backing, a tray, and a plurality of dividers configured to be customizable. However, the system of the '802 patent is disadvantageous because the tray and backing are of fixed size thereby limiting customization and requiring manufacture and complete replacement of different sizes of backing and trays.

As can be seen, there is a need for a modular retail shelving system configured to be customizable that addresses the disadvantages of the prior art.

SUMMARY OF THE INVENTION

In one aspect of the present invention, a modular retail shelving apparatus is provided. In embodiments the modular retail shelving apparatus is customizable and reconfigurable to suit the needs of the user. The modular retail shelving apparatus has at least two mounting brackets, each mounting bracket of the at least two mounting brackets having, a plurality of mounting posts protruding from a first face, a first mounting slot in a second face, and a second slot in a third face, wherein the first slot is substantially perpendicular to the second mounting slot; a ledge having a plurality of divider slots disposed within a first face, a first tab disposed on a first end of the ledge and a second tab disposed on a second end of the ledge; and a tray having a first plurality of tray post protruding from a first face, a second plurality of tray posts protruding from the first face, a first tray slot disposed within the first face and proximate to a first end, and a second tray slot disposed within the first face and proximate to a second end.

Additionally, one or more dividers with a plurality of divider posts protruding from a first face thereof can be provided, and can be mounted to one or more of the divider slots. The modular retail shopping apparatus can be mounted to a backing, such as a pegboard, which can allow configuration limited only by the locations of holes within the backing.

These and other features, aspects and advantages of the present invention will become better understood with reference to the following drawings, description, and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

In addition to the disadvantages of prior art modular shelving systems listed above, no current modular shelving systems are constructed to secure lightweight, and/or thinner products that have difficulty standing upright on their own.

Broadly, one embodiment of the present invention is a modular retail shelving apparatus configured to be secured to a backing in a customizable configuration to suit a specific product or need. The modular retail shelving apparatus of the present invention can include at least two mounting brackets, a ledge portion, a tray portion, and at least one divider, which can be arranged on a backing in a customizable configuration to suit a specific product or need. The present invention eliminates the need to fully disassemble retail shelving to change a configuration, such as number of dividers, length of a tray portion, or length of a ledge portion, etc. Additionally, the present invention provides sufficient depth to allow products such as greeting cards, stickers, etc., to be displayed upright, securely, without falling over.

The present invention can be monolithically formed, or manufactured, utilizing injection molding, 3-D printing, laser cutting, or other additive manufacturing techniques. The present invention can be formed of polymer materials such as acrylic, or other plastics, and can be transparent. Alternatively, the present invention can be formed of organic materials, and/or engineered materials.

Referring to FIGS. 1-5, FIG. 1 illustrates an embodiment of a fully assembled modular retail shelving apparatus. In embodiments, the modular retail shelving apparatus can be mounted to a backing 44 including a plurality of holes 46 configured for customized mounting. In embodiments, backing 44 can be a pegboard and the plurality of holes can be pegboard holes, but is not so limited. Advantageously, placement of components of the modular retail shelving apparatus are limited only by the number, spacing, and/or location of the plurality of holes.

Figure 3:
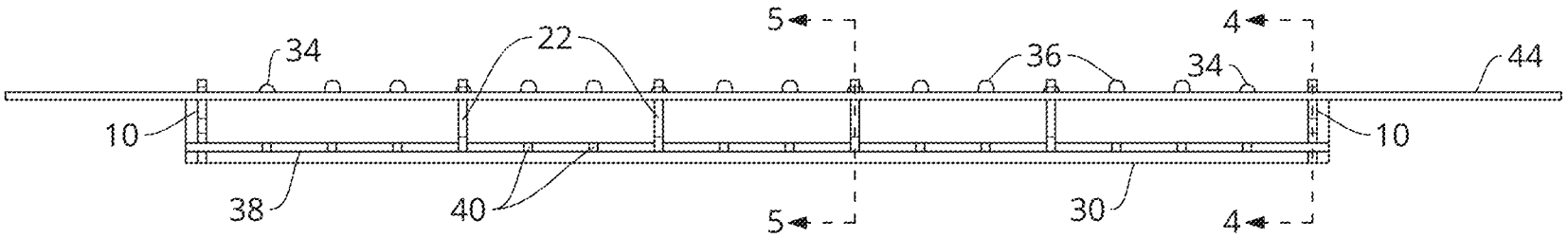
FIG. 3 is a top plan view of an embodiment of a modular retail shelving apparatus, according to aspects of the present invention.

At least two mounting brackets 10 can be mounted to backing 44 via a subset of the plurality of holes 44. In embodiments, the at least two mounting brackets 10 can form end caps for the modular retail shelving apparatus. Additionally, the at least two mounting brackets 10 can be configured to receive and secure a ledge portion 38 and a tray portion 30. In embodiments, the ledge portion 38 can include a plurality of slots 40 configured to receive a plurality of dividers 22, in a manner dictated by the needs of a user of the modular retail shelving apparatus as illustrated in FIG. 3. In embodiments, the tray portion 30 can form a shelf configured to support products in the modular retail shopping apparatus as illustrated in FIG. 3. Advantageously, portions of the modular retail shelving apparatus, such as dividers, can be moved, repositioned, or otherwise reconfigured, without the need to disassemble the remaining components of the modular retail shelving apparatus.

Figure 1:
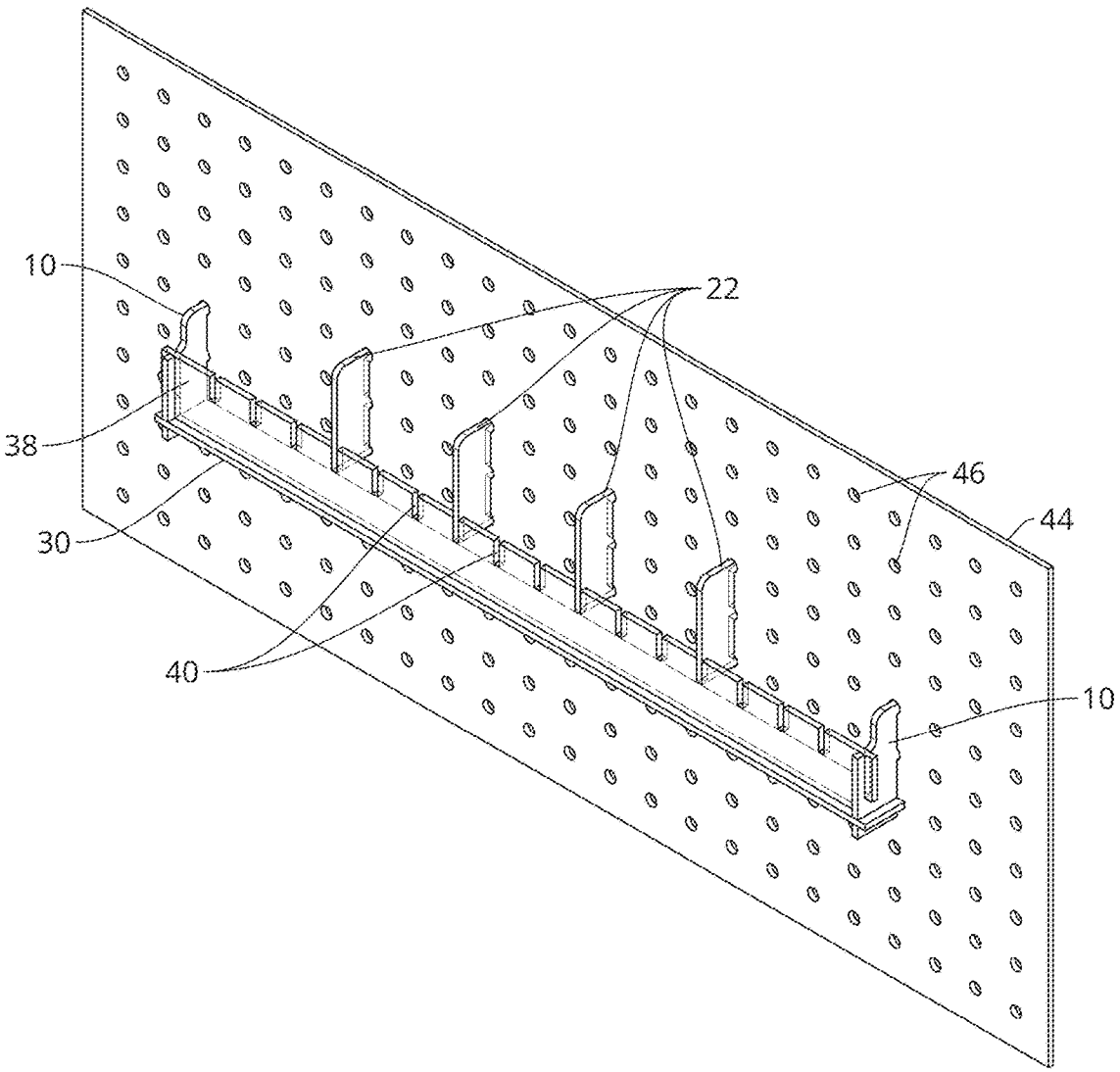
FIG. 1 is a perspective view of an embodiment of a modular retail shelving apparatus, according to aspects of the present invention.
Figure 2:
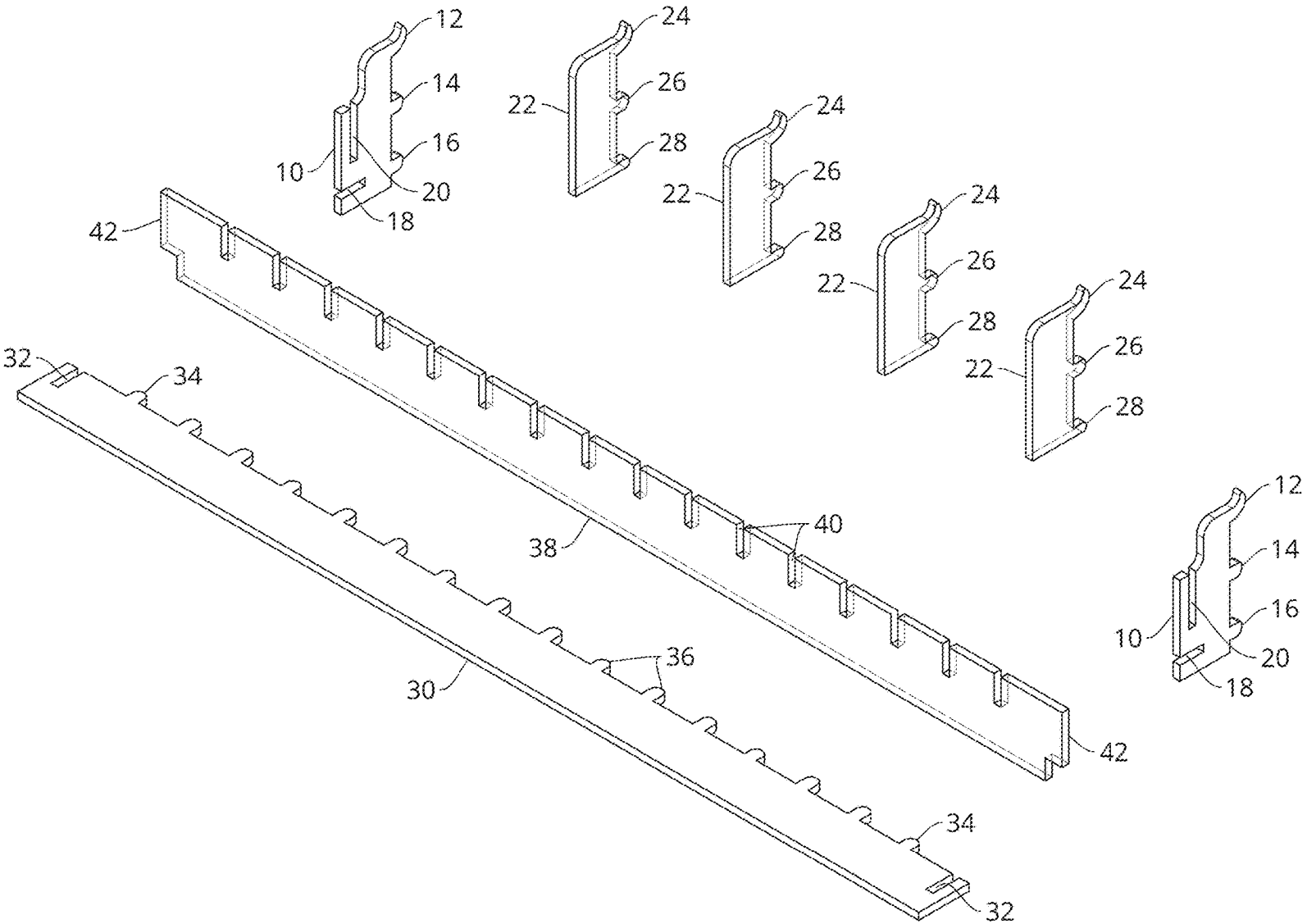
FIG. 2 is an exploded view of an embodiment of a modular retail shelving apparatus, according to aspects of the present invention.
Figure 4:
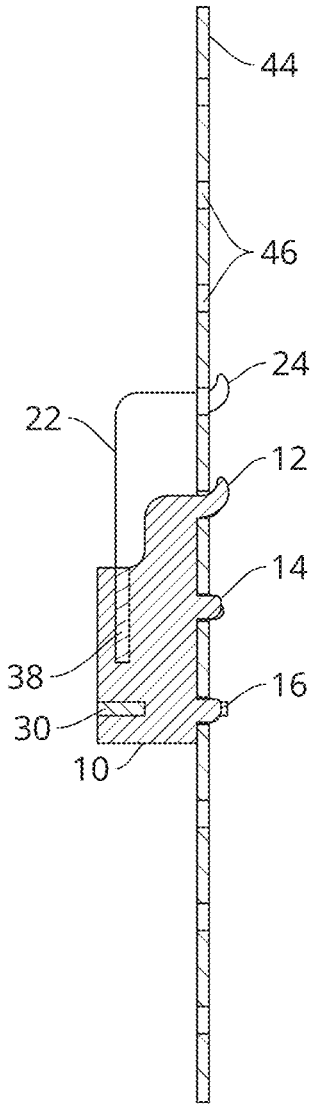
FIG. 4 is a cross-sectional view of an embodiment of a modular retail shelving apparatus taken along line 4-4 of FIG. 3, according to aspects of the present invention.

FIG. 2 illustrates an exploded view of an embodiment of the modular retail shelving apparatus. A bracket 10 of the at least two brackets can be monolithically formed and can include a bracket post 12, a middle bracket post 14, and a lower bracket post 16 configured to secure bracket 10 to backing 44. In embodiments, bracket post 12 can be curved in a claw shape so as to prevent bracket 10 from inadvertently becoming detached from backing 44 as illustrated in FIGS. 3-4. In embodiments, middle bracket post 14, and lower bracket post 16 can be similarly shaped and can be configured to prevent excessive movement of bracket 10 while affixed to backing 44 as illustrated in FIGS. 3-4. Additionally, bracket 10 can include a tray portion slot 18 and a ledge portion slot 20. In embodiments, tray portion slot 18 can be oriented substantially horizontally when bracket 10 is mounted to backing 44 and is configured to accept a tray slot 32 of tray portion 30. In embodiments, ledge slot portion 20 can be oriented substantially vertically when bracket 10 is mounted to backing 44 and is configured to accept a ledge slot 42 of ledge portion 38. Advantageously, tray slot portion 18 and ledge slot portion 20 can be sized in order to provide friction fitting between each of the slot portions and their corresponding slot.

Figure 5:
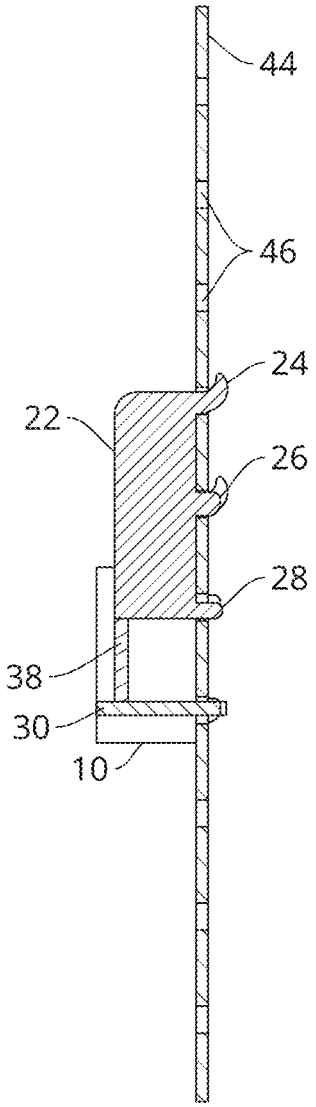
FIG. 5 is a cross-sectional view of an embodiment of a modular retail shelving apparatus taken along line 5-5 of FIG. 3, according to aspects of the present invention.

A divider 22 of the plurality of dividers can be monolithically formed and can include a divider post 24, a middle divider post 26, and a lower divider post 28 configured to secure divider 22 to backing 44 as illustrated in FIGS. 3 and 5. In embodiments, divider post 24 can be curved in a claw shape so as to prevent divider 22 from inadvertently becoming detached from backing 44 as illustrated in FIGS. 3 and 5. In embodiments, middle divider post 26, and lower divider post 28 can be similarly shaped and can be configured to prevent excessive movement of divider 22 while affixed to backing 44 as illustrated in FIGS. 3 and 5. Additionally, divider 22 can be sized in order to provide friction fitting between a slot 40 of the plurality of slots and can be positioned, or arranged, in a manner to suit the needs of the modular shelving apparatus.

A tray portion 30 can be monolithically formed and can include a plurality of tray slots 32, a plurality of short posts 34, and a plurality of long posts 36. In embodiments, each tray slot 32 of the plurality of tray slots can be disposed proximate to an end of tray portion 30 opposite of one another. Each of tray slots 32 can be configured to interface with a tray slot portion 18 of a bracket 10 and can be sized in order to provide friction fitting between itself and a tray slot portion 18. In embodiments, the plurality of short posts 34 and the plurality of long posts 36 can be configured to interface with backing 44, as illustrated in FIG. 3, and can provide support for tray portion 30 thereby preventing sagging while supporting products in the modular retail shelving apparatus. In embodiments, the plurality of short posts 34 have less length than the plurality of long posts 36. In embodiments, the plurality of short posts 34 can have more width than the plurality of long posts 36. In embodiments, the plurality of short posts 34 and the plurality of long posts 36 can be placed in a pattern, for example, every third post can be a short post 34. Advantageously, utilization of the plurality of short posts 34 can provide better attachment to backing 44, while the plurality of long posts 36 can maintain ease of collapsibility.

A ledge portion 38 can be monolithically formed and can include a plurality of divider slots 40, and a plurality of bracket tabs 42. In embodiments, divider slots 40 can be spaced along a top portion of ledge portion 38 and can be oriented substantially vertically when ledge portion 38 is installed on the modular shelving apparatus. In embodiments, divider slots 40 can be sized in order to provide friction fitting between a divider slot 40 and a divider 22 as illustrated in FIGS. 3 and 5. In embodiments, each of the plurality of bracket tabs 42 can be disposed proximate to an end of ledge portion 38 opposite of one another. Additionally, each of the plurality of bracket tabs 42 can be configured to interface with a ledge slot portion 20 of a bracket 10 and can be sized to provide friction fitting between itself and the ledge slot portion 20. Advantageously, ledge portion 38 can provide security by preventing products positioned in the modular shelving apparatus from becoming dislodged, or otherwise falling out.

FIG. 4 is a cross-sectional view of the modular shelving apparatus taken along line 4-4 of FIG. 3. FIG. 4 more clearly illustrates the interface between bracket 10 and backing 44. Specifically, bracket post 12, middle bracket post 14, lower bracket post 16 of bracket 10 each fit within one of the plurality of holes 46. Bracket post 12 can be claw-shaped such that a tip portion of the claw can prevent bracket from being intentionally or unintentionally removed from one of the plurality of holes 46. Additionally, a vertical orientation and friction fit of ledge portion 38 within ledge slot portion 20 is shown, and a horizontal orientation and friction fit of tray portion 30 within tray slot portion 18 is shown.

FIG. 5 is a cross-sectional view of the modular shelving apparatus taken along line 5-5 of FIG. 3. FIG. 5 more clearly illustrates the interface between divider 22 and backing 44. Specifically, divider post 24, middle divider post 26, and lower divider post 28 of divider 22 each fit within one of the plurality of holes 46. Divider post 24 can be claw-shaped such that a tip portion of the claw can prevent divider from being intentionally or unintentionally removed from one of the plurality of holes 46. Additionally, a vertical orientation and attachment of divider 22 to backing 44 is shown.

It should be understood, of course, that the foregoing relates to exemplary embodiments of the invention and that modifications may be made without departing from the spirit and scope of the invention as set forth in the following claims.

What is claimed is:

1. A modular retail shelving apparatus, comprising:

at least two mounting brackets, each mounting bracket of the at least two mounting brackets comprising:

a plurality of mounting posts protruding from a first face;

a first mounting slot in a second face; and a second mounting slot in a third face, wherein the first mounting slot is substantially perpendicular to the second mounting slot;

a ledge comprising:

a plurality of divider slots disposed within a first face;

a first tab disposed on a first end of the ledge; and a second tab disposed on a second end of the ledge, wherein the first tab is couplable to the first mounting slot of one of the at least two mounting brackets and the second tab is couplable to the first mounting slot of the other of the at least two mounting brackets; and a tray comprising:

a first plurality of tray posts having a first length protruding from a first face;

a second plurality of tray posts having a second length protruding from the first face;

a first tray slot disposed within the first face and proximate to a first end; and a second tray slot disposed within the first face and proximate to a second end, wherein the first tray slot is couplable to the second mounting slot of one of the at least two mounting brackets and the second tray slot is couplable to the second mounting slot of the other of the at least two mounting brackets.

2. The modular retail shelving apparatus of claim 1, further comprising:

at least one divider having a plurality of posts protruding from a first face, wherein the at least one divider is configured to be inserted into one of the plurality of divider slots.

3. The modular retail shelving apparatus of claim 1, further comprising:

a backing having a plurality of holes disposed thereon, the backing configured to receive at least one of the plurality of mounting posts of each of the at least two mounting brackets.

* * * * *